US009157620B2

(12) United States Patent
Bowness et al.

(10) Patent No.: US 9,157,620 B2
(45) Date of Patent: Oct. 13, 2015

(54) MOUNTING ARRANGEMENT AND METHOD FOR MOUNTING AN OPTICAL MEMBER TO AN OBLONG LUMINAIRE

(71) Applicant: THORN LIGHTING LTD., Durham (GB)

(72) Inventors: Anton Bowness, Tyne and Wear (GB); Raymond Keane, Durham (GB); Joanne Mailen, Durham (GB); Darren Feasey, Durham (GB)

(73) Assignee: THORN LIGHTING LTD., Durham (GB)

( * ) Notice: Subject to any disclaimer, the term of this patent is extended or adjusted under 35 U.S.C. 154(b) by 0 days.

(21) Appl. No.: 14/347,546

(22) PCT Filed: Oct. 12, 2012

(86) PCT No.: PCT/EP2012/070235

§ 371 (c)(1),
(2) Date: Mar. 26, 2014

(87) PCT Pub. No.: WO2013/053875

PCT Pub. Date: Apr. 18, 2013

(65) Prior Publication Data

US 2014/0240982 A1 Aug. 28, 2014

(30) Foreign Application Priority Data

Oct. 12, 2011 (EP) ..... 11275123

(51) Int. Cl.

| | |
|---|---|
| ***F21V 21/14*** | (2006.01) |
| ***F21V 15/015*** | (2006.01) |
| ***F21V 17/10*** | (2006.01) |
| *F21V 3/02* | (2006.01) |
| *F21Y 103/00* | (2006.01) |

(52) U.S. Cl.

CPC ..... *F21V 21/14* (2013.01); *F21V 15/015* (2013.01); *F21V 17/102* (2013.01); *F21V 3/02* (2013.01); *F21Y 2103/00* (2013.01); *Y10T 29/49826* (2015.01)

(58) Field of Classification Search

CPC .... F21Y 2103/00; F21Y 2113/00; F21S 8/04; F21S 4/003; F21V 17/10; F21V 7/06

USPC ..... 362/235

See application file for complete search history.

(56) References Cited

U.S. PATENT DOCUMENTS

| | | | |
|---|---|---|---|
| 2,490,191 | A | 12/1949 | Baker |
| 2,833,916 | A | 5/1958 | Foulds |

(Continued)

FOREIGN PATENT DOCUMENTS

| | | | |
|---|---|---|---|
| DE | 2453427 | A1 | 5/1976 |
| FR | 2658588 | A1 | 8/1991 |
| GB | 2475613 | A | 5/2011 |
| JP | 2002298633 | A | 10/2002 |

OTHER PUBLICATIONS

International Search Report for PCT/EP2012/070235, dated Apr. 24, 2013.

*Primary Examiner* — Tracie Y Green

(74) *Attorney, Agent, or Firm* — Marshall, Gerstein & Borun LLP

(57) ABSTRACT

A mounting arrangement for mounting an optical member to an oblong luminaire, comprising a plurality of mounting members, arranged to be fixed to an end cap at the narrow side of an oblong luminaire and to accommodate the optical member, wherein the plurality of mounting members comprises a first type of mounting member and a second type of mounting member.

18 Claims, 8 Drawing Sheets

(56) References Cited

U.S. PATENT DOCUMENTS 2,886,699 A 5/1959 Harling
5,577,779 A * 11/1996 Dangel ..... 292/80
2008/0247171 A1* 10/2008 Tyson ..... 362/299
2013/0021792 A1* 1/2013 Snell et al. ..... 362/218

* cited by examiner

MOUNTING ARRANGEMENT AND METHOD FOR MOUNTING AN OPTICAL MEMBER TO AN OBLONG LUMINAIRE

BACKGROUND OF THE INVENTION

1. Field of the Invention

The present invention is directed to a mounting arrangement for mounting an optical member to an oblong luminaire.

2. Related Technology

Oblong luminaires are well known in the lighting industry and are commercially available for a variety of applications. Especially for the lighting of interior areas a number of respective luminaire models is available. For industrial or commercial areas the use of cost efficiently designed luminaires is common. These luminaires are usually provided with a basic functionality, lacking the possibility to adapt the light emission to various needs, which might arise in the course of time.

Furthermore, considering the weight and dimension of oblong luminaires, installing respective devices requires significant efforts; in many cases a plurality of skilled workers and auxiliary personal is mandatory, adding to substantial installation costs.

SUMMARY OF THE INVENTION

Accordingly, an object of the present invention is improving the possibility to adapt the light emission of an oblong luminaire and respectively facilitating the installation and maintenance.

This object is solved by a mounting arrangement for an optical member to an oblong luminaire, a combination of a mounting arrangement and an optical member, a luminaire, and a method for mounting an optical member to an oblong luminaire.

According to the invention, a mounting arrangement for mounting an optical member to an oblong luminaire is provided, comprising a plurality of mounting members, being arranged to be fixed to an end cap at the narrow side of an oblong luminaire and to accommodate the optical member. Furthermore, the plurality of mounting members comprises a first type of mounting member and a second type of mounting member, respectively denoted as a mounting member of a first type and a mounting member of a second type.

Aided by respective first type and second type mounting members arranged at the end cap of an oblong luminaire, possibilities arise, to deviate from a mounting method, requiring to keep the optical member manually in an essentially parallel orientation to a housing of the luminaire for a substantial time, while mounting the optical member.

Furthermore, providing an optical member to an oblong luminaire, favorably enables an alteration of the light emission of the luminaire, thus likewise flexibility is enhanced to adapt the luminaire to various needs while reducing respective efforts significantly.

Advantageously, the first type of mounting member is provided to accommodate the optical member pivotable. Being mounted to the end cap at the narrow side of the luminaire, optical members, especially favorable long and extending, can be hooked to the mounting member of the first type in a preferably tilted position, immediately supporting the weight of the optical member during the mounting process. Hence also rather extending optical members can be handled by a minimum number of workers or auxiliary personal.

Accordingly, an aspect of the invention is to providing a method for mounting an optical member to an oblong luminaire comprising the steps of A) combining the optical member with the first type of mounting member, provided at a narrow end of the luminaire;

B) rotating the optical member around a pivoting axis perpendicular to a longitudinal direction of the luminaire;

C) combining the optical member with the second type of mounting member, provided at another narrow end of the luminaire.

As already hinted, the described method significantly facilitates the mounting process for an optical member, in particular for an oblong optical member, as it is commonly the case, for an optical member being mounted to both narrow ends of the oblong luminaire. Being accommodated at one end, the weight of the optical member is immediately supported, reducing the effort of a single worker to a minimum. Furthermore, provided with the possibility to be rotated and to enclose various angles with the luminaire, the optical member can be combined with the opposing narrow end of the luminaire, while maintaining permanent contact with the mounting member of the first type, thus receiving constant support during the mounting procedure.

An advantageous modification of the method further comprises the step of first mounting the luminaire, respectively the luminaire housing to a carrier for the oblong luminaire and then mounting the optical member to the oblong luminaire. Aided by first and second type mounting members, the optical member is separable from the luminaire, in particular from the luminaire housing. Respectively fostering the mounting process, a series of steps is described in the foregoing, requiring minimum weight support during each of the steps.

Advantageously, the method comprises combining the first type of mounting member and the second type of mounting member to narrow end faces of the luminaire obviating the usage of tools. As readily perceived, the mounting process is further facilitated, enhancing the possibility to significantly speed up the mounting process, thus reducing efforts and likewise increasing flexibility.

Preferably the mounting member of the first type is provided with a flat pivoting face projecting from a central, preferably polygonal body. Favorably avoiding a fixed combination and also a fixed pivoting point, the pivoting face can serve as bearing, providing multiple pivoting points for the optical member. More advantageously, although obviating a fixed connection to the optical member, weight of the optical member is supported—at least in part—by the mounting member of the first type during the mounting process, fostered in particular by the stable construction of the central body of the first type mounting member.

Advantageously being located at the opposing narrow end of the oblong luminaire, the second type of mounting member is preferably provided to combine snap-fittingly with the optical member, even more preferably with a "clicking" sound.

Hence in addition to the mounting member of the first type, also the mounting member of the second type is arranged to accommodate the optical member, obviating the usage of tools. Furthermore, acoustical feedback to the user can be provided by the "clicking" sound, assuring a save connection of the optical member to the luminaire.

Preferably the second type of mounting member is provided with a snap-fitting clip, projecting from a central, preferably polygonal body, raising both the possibility to combine the optical member obviating the usage of tools and emitting a "clicking" sound; a swift and readily achievable connection between the luminaire housing and the optical member is stipulated.

In an advantageous modification of the invention and as already hinted, the mounting members of the first and second type and the optical member are provided to be combined and separated, obviating the usage of tools. Furthermore also the mounting members of the first and second type can be arranged to be combined to the luminaire and separated, obviating the usage of tools.

Accordingly, a variety of modifications is conceivable within the framework of the invention; preferably latching or snap-fitting means are provided to realize respective connections. Advantageously, at least one of the combinations provides a hook type connection, wherein a "hook-like structure" is arranged at the optical member and a respective matching member is provided at the mounting member.

Preferably for the combination of mounting members of the first or second type and the luminaire, in particular with the housing or end caps of the luminaire, a sliding connection is also favorable.

A further aspect of the invention extends also to a combination of a mounting arrangement according to the invention and an optical member, wherein the optical member is preferably provided with a pivoting means.

Advantageously, the pivoting means is comprised in a hook like combination of the mounting member, preferably a mounting member of the first type, and the optical member, fostering a readily pivotable combination of both members.

A modification of the invention stipulates, providing the plurality of mounting members to combine with the end caps at a surface forming an inner surface of the luminaire when being in a mounted position.

Favorably arranging both the plurality of mounting members invisibly from the exterior of the luminaire and keeping the optical properties unaltered, possibilities to mount an optical member to a luminaire are optimized.

Advantageously, the optical member is formed by a plurality of preferably latchingly combined members; more preferably a central member is formed by a trough like diffuser and the optical member advantageously comprises abutting end caps of the trough. Hence, the optical member consists of a plurality of members combinable and separable obviating the usage of tools.

A further aspect of the invention is directed to an oblong luminaire, comprising a combination of a mounting arrangement and an optical member according to invention. Furthermore, the oblong luminaire also comprises a housing, provided with end caps at the narrow sides of the luminaire and one or more lamps. Preferably the lamps are oblong lamps, more preferably oblong, fluorescent lamps.

In an advantageous modification of the invention the optical member, when mounted to the luminaire, exceeds the dimension of the narrow side of the luminaire housing or projects out of the housing, respectively of the end caps. And more preferably the mounting members are arranged to extend beyond the narrow side of the housing of the luminaire and more preferably beyond the end caps.

Favorably, the interior space of the luminaire circumscribed by the combination of the optical member and the housing can be altered by the use of various optical members. Fostering the use of a variety of different lamp types by said dimensions of the optical member, single or double batten lamps are conceivable in combination with the oblong luminaire. Preferably, the geometrical center of the twin batten arrangement is identical to the single batten configuration.

BRIEF DESCRIPTION OF THE DRAWING

In the following, the present invention and preferred embodiments thereof are explained in more detail with respect to the enclosed drawing. It is shown in FIG. 1 *a-c*) an embodiment of a mounting member of the first type.

DETAILED DESCRIPTION OF THE INVENTION

Figure 1A:
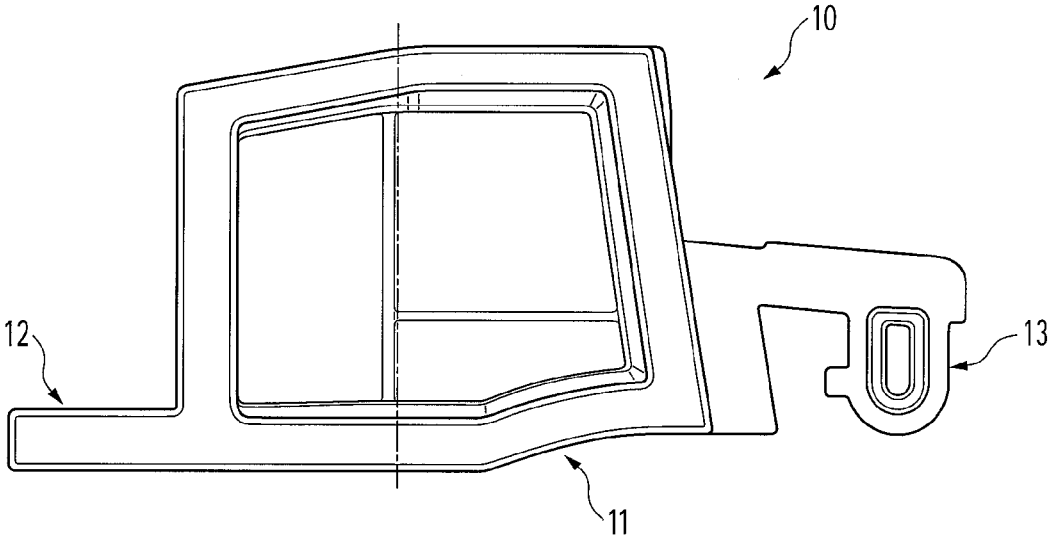

The present invention is based on the need to foster a swift and easy mounting process of an optical member 30 to an oblong luminaire, both enhancing the possibilities to employ unskilled personal to this task, reducing efforts and enabling a flexible alteration of optical properties of an oblong luminaire.

According to the invention, a plurality of mounting members 10, 20 is provided at the narrow ends of the luminaire, preferably mating with end caps of the luminaire arranged at the narrow end. The mounting members can be arranged to be combinable to a specific luminaire model or a make-series of luminaires, but also a retrofit approach is conceivable within the scope of the invention.

The plurality of mounting members 10, 20 comprises a first type of mounting member 10 and a second type of mounting member 20; respectively the plurality of mounting members 10, 20 comprises a mounting member of a first type 10 and a mounting member of a second type 20.

Following the single embodiment as outlined in FIGS. 1 to 6, a mounting member of the first type 10 is arranged at one narrow end of the oblong luminaire, whereas a mounting member of the second 20 type is provided at the opposing narrow end of the luminaire.

However it is to be pointed out that the invention is not limited to the depicted single embodiment, various alterations are conceivable likewise.

As will become apparent in the following, providing two types of mounting members at opposing narrow ends of the oblong luminaire exhibits a variety of benefits, which synergetically interact and aggregate in a method for mounting an optical member to an oblong luminaire.

Figure 5B:
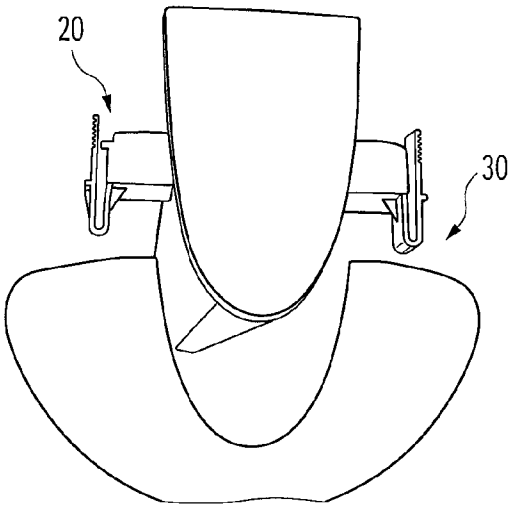
FIG. 5 *a-c*) steps of a method for mounting an optical member to an oblong luminaire.
Figure 5A:
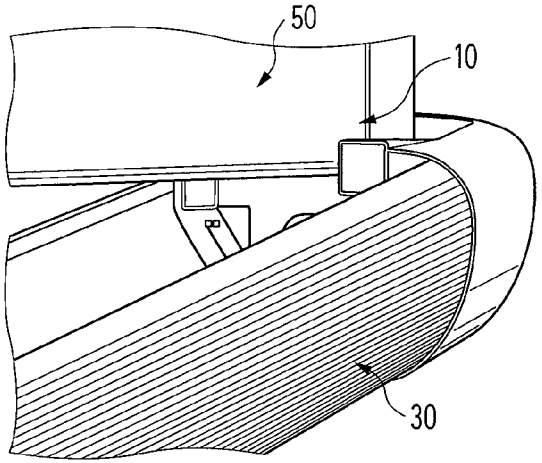
Figure 5C:
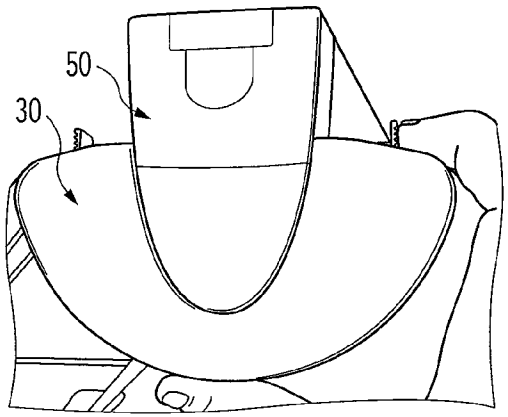

Several steps of a respective method are depicted in FIGS. 5*a* to 5*c*. As will be readily appreciated, the optical member 30 is repeatable combinable to and separable from the luminaire, obviating the usage of tools. Favorably, opportunity is created for mounting the respective oblong luminaire to a carrier structure independently of the optical member 30 in a commencing step. Hence, the initial weight, requiring support during the installation of the luminaire, can be significantly reduced.

As can be derived from FIG. 5*a*, a further step of the method comprises A) combining the optical member 30 with the mounting member of the first type 10 provided at a narrow end of the luminaire.

Stipulating a first type of mounting member 10 at one end of the oblong luminaire and a second type of mounting member 20 at an opposing end brings about the possibility to combine the luminaire and the optical member 30 deviating from a method of keeping the luminaire and the optical member 30 largely parallel during the mounting procedure.

As can be further derived from FIG. 5*a*, and as will be explained in more detail below, the mounting member of the first type 10 is provided to accommodate the optical member 30 rotatable. Even more favorable, the optical member 30 can be mounted to and combined with the mounting member of the first type 10, choosing from a variety of different approaching and joining angles. In particular, the mounting member of the first type 10 and the optical member 30 are provided to be hooked to each other.

Benefiting from the possibility to choose from a plurality of approaching angles, a single worker, holding the optical member 30 at one end, can readily combine optical members 30 opposing end with the mounting member of the first type 10.

In a following step B) is stipulated, rotating the optical member 30 around a pivoting axis perpendicular to a longitudinal direction of the luminaire. As still can be seen from FIG. 5*a*, the mounting member of the first type 10 exhibits a respective pivoting point.

While being accommodated by the mounting member of the first type 10 the optical member is rotated, bringing the opposing end of the optical member 20 into proximity of the luminaire. A further step C) of method can be derived from FIGS. 5*b* and 5*c*, comprising combining the optical member 30 with a mounting member of the second type 20 provided at the other narrow end of the luminaire.

The respective mounting member of the second type 20 is provided with sliding faces, which will be described in more detail later on, also fostering the approach of the mounting member of the second type 20 and the optical member 30 from a variety of angles, respectively from a rotating movement.

As can be derived from FIG. 5*c*, the mounting member of the second type 20 can actuated from the exterior of the luminaire without the usage of tools to release the optical member 30, respective actuating faces protruding to the exterior of the luminaire are arranged on the mounting member of the second type 20.

Above all, the invention provides a swift and readily achievable method for mounting an optical member 30 to a luminaire, both improving flexibility and optimizing efforts during the mounting process.

Figure 1B:
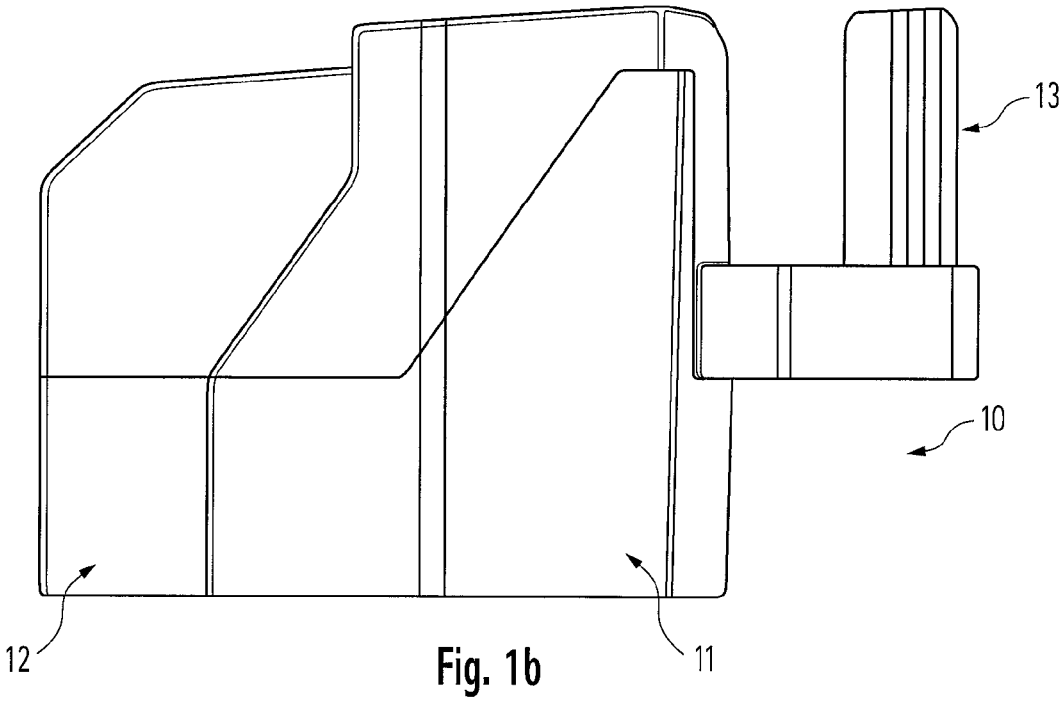

A respective embodiment of a mounting member of the first type 10 is shown in FIGS. 1*a* and 1*b*. The depicted mounting member of the first type 10 comprises a tubular central body 11, with a basically polygonal cross section. The polygonal cross section tapers towards one end of the central body 11 providing a first member of a hook bearing. Abutting the central body 11, flat projecting pivoting faces 12 are arranged. The flat pivoting face 12 represents a plurality of pivoting points or axes, arranged to provide a bearing for the optical member 30, accommodating said optical member 30 rotatable. The flat pivoting face 12 provides a second member for a hook bearing.

Furthermore, the central body 11 comprises adjacent to the pivoting face 12 orthogonally arranged guiding faces, supporting the pivoting movement of the optical member 30, providing a third member of a hook bearing. Hence, the mounting member of the first type 10 comprises bearing means, accommodating the optical member 30 pivotally. Nevertheless, said members are still separable, avoiding any usage of tools.

As also shown in FIGS. 1*a* and 1*b*, the mounting member of the first type 10 comprises attachment means 13, arranged to combine with the luminaire, in particular with end caps arranged at a narrow side of the oblong luminaire. Projecting arms are arranged on the central body 11, opposing the flat pivoting faces. Increasing stability, the projecting arms are arranged form fittingly with the luminaire. Comprising a preferably polygonal dowel arranged on the projecting arms, the attachment means 13 are provided to mate with an opening in or on the end cap of the luminaire. The dowel is arranged elastically, preferably exceeding the opening provided in the end cap in size. The advantageously polygonal formed cross section of the dowel provides headroom to fit the dowel to the opening, exhibiting elastic force towards the circumference of the opening. However, also cutouts in the dowel are conceivable to provide respective headroom.

Forming guiding means, the dowel, and thus attachment means 13 are arranged to be combined with the luminaire obviating the usage of tools. Likewise a separation of the mounting member of the first type 10 from the luminaire is possible.

However, not limited to a retrofit approach, a variety of attachment means are conceivable, including the possibility of magnetically fitting the mounting members of the first of second type 10, 20 to the luminaire, and respectively gluing, soldering, welding, bolting or screwing favorable attachment means to the luminaire, arranged to cooperate, preferably in a tool less manner, with the attachment means 13, 23 (cf. FIGS. 2*a* to *c*) of the mounting members of the first 10 respectively the second type 20.

Figure 1C:
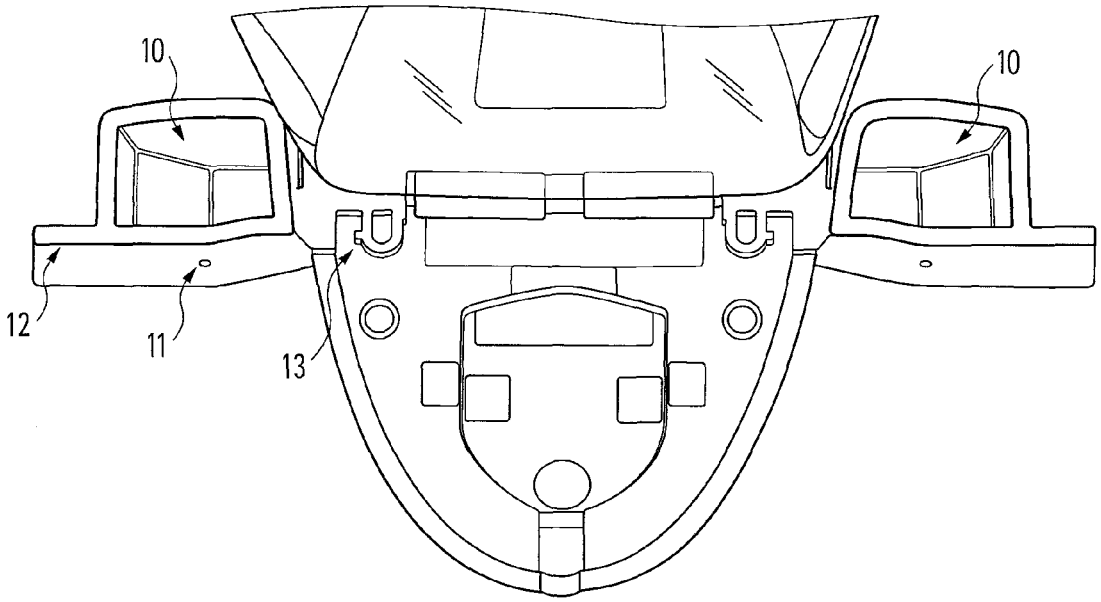

FIG. 1*c* shows mounting members of the first type 10 combined to the end cap of an oblong luminaire. The first type of mounting members 10 comprises two mirror symmetrical makes, which are arranged to extend or project beyond the housing, in particular beyond the end caps, of the luminaire. Projecting horizontally beyond the end caps, the mounting member of the first type 10 provides said pivoting faces 10 in a horizontally aligned manner, readily supporting the weight of the optical member 30, which can be hooked with the mounting member of the first type 10 and rotated around a pivoting axis, aligned perpendicular to the longitudinal axis of the luminaire.

Figure 3B:
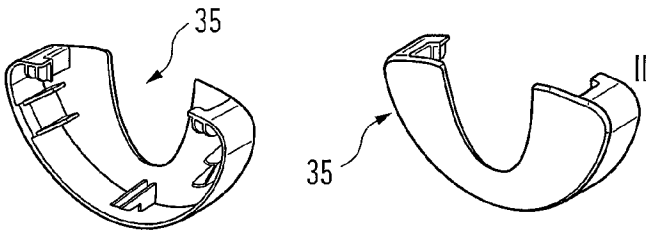
FIG. 3 *a-c*) an embodiments of an end cap of an optical member.
Figure 3C:
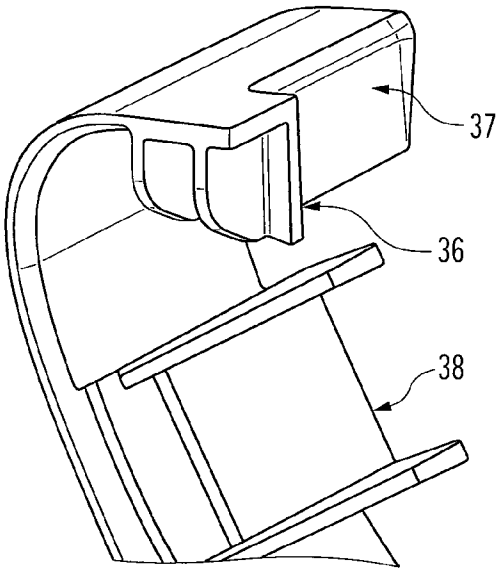
Figure 3A:
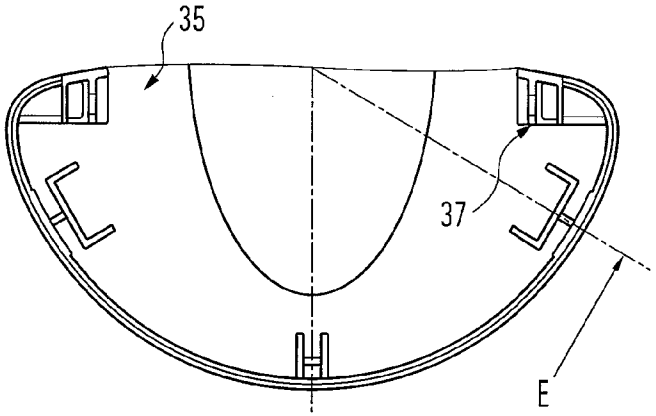
Figure 4B:
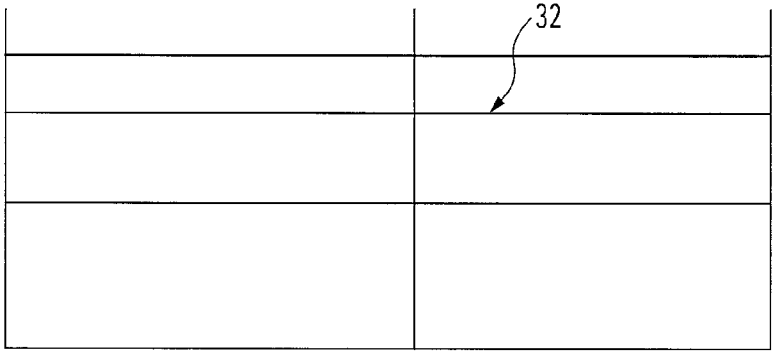
FIG. 4 *a-c*) an embodiment of an optical member comprising a diffuser member.
Figure 4A:
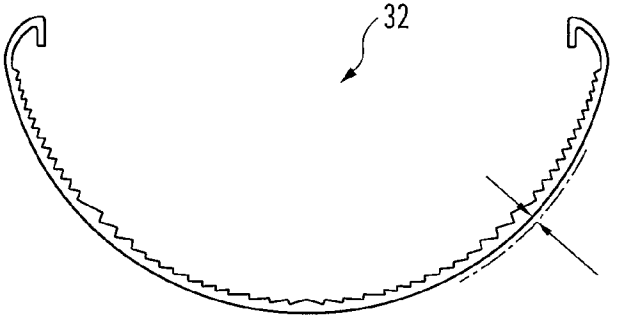
Figure 4C:
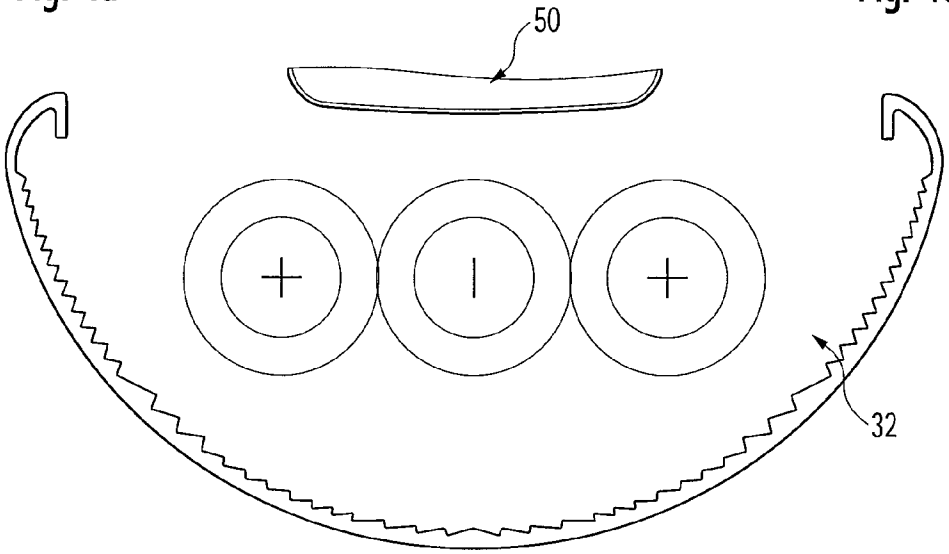

The optical member 30 is provided with respective pivoting means 36, as is best seen from FIGS. 3*a* to 3*c*. The optical member of the depicted embodiment consist of a plurality of members 32 and 35, which are arranged to be combined obviating the usage of tools, improving adaptability to various kinds of luminaires likewise. However, a unitary optical member 30 is also conceivable.

The specific embodiment of FIGS. 3*a* to 3*c* provides pivoting means 36, arranged on end caps of the optical member 30. Exhibiting substantially an "L"-shape or a hook-shape, as especially favorable depicted in FIG. 3*c*, a linear flange representing one side of the "L", provides a pivoting axis perpendicular to the longitudinal axis of the luminaire. Angled, orthogonally arranged, protrusions of the linear flange are formed to control the tilting angle of the optical member 30 with respect to the mounting member of the first type 10, in particular when moved up to the flat pivoting face 12.

Furthermore, a chevron like cutout of the "L"-shaped pivoting means 36, provides likewise a "hook like structure" or a hook like connection to the mounting member of the first type 10. The cutout is arranged to combine with the central body 11 of the mounting member of the first type 10 at least in part form-fittingly. Mentioned guiding faces, provided on the central body 11, supporting a rotational movement of the optical member 30, taper to snap into the chevron like cutout. Furthermore the "L"-shaped pivoting means 36 are provided with top faces which limit the tilting angle of the optical member 30; when the optical member 30 is brought to a final mounting position, respective top faces align with the central body 12 of the mounting member of the first type 10 essentially parallel to the said pivoting faces 12 arranged thereon.

Thus, the optical member 30, or respective end cap 32 of the optical member 30, comprises pivoting means 36, arranged to combine with the mounting member of the first type 10, obviating the usage of tools, being separable, likewise obviating the usage of tools and being pivotable.

Furthermore, the end caps 32 of the optical member are provided to combine with a diffuser member 35, comprising respective combination means. Accordingly, favorable resilient clamps or clamping blocks are provided on the end cap 32, following the form of the diffuser member 34 at multiple mounting points provided on the end cap 32. Being slid into said clamps, the diffuser member 35 is combined with the end cap 32, in a tool less manner. Benefiting from pivoting means 36 being arranged on the end cap 32 of the optical member 30, a variety of optical properties can be achieved by exchanging the central diffuser member 35. It is to be emphasized, that the invention is not limited to a member 35 exhibiting diffusing properties; above all, an adaption to various optical demands can be achieved by the simple exchange of the optical member 30 or preferably the central diffuser member 35, comprised in the optical member 30.

The described embodiment of the invention comprises a trough like oblong, central diffuser member 35 with abutting end caps 32, arranged at the narrow side of the trough.

When mounted to the luminaire, the optical member 30 exceeds the dimension, respectively projects beyond the narrow side of the luminaire housing 50. Fostering the use of a variety of lamp types, the optical member 30 provides additional headroom, to arrange preferably a one, or more preferably, a two batten type fluorescent lamp. Advantageously the lamp types T16 or T26 are used. A respective modification of the arrangement is hinted in FIG. 4*c*.

Once combined at one end with the mounting member of the first type 10, the optical member 30 is accommodated rotatable around an axis perpendicular to the longitudinal axis of the oblong luminaire. Pivoted to the mounting member of the second type 20, the opposing end can be combined snap-fittingly with the mounting member of the second type 20. Respective predescribed pivoting means 36, arranged on the end cap 35 of the optical member 30, also foster the combination with the mounting member of the second type 20.

Figure 2A:
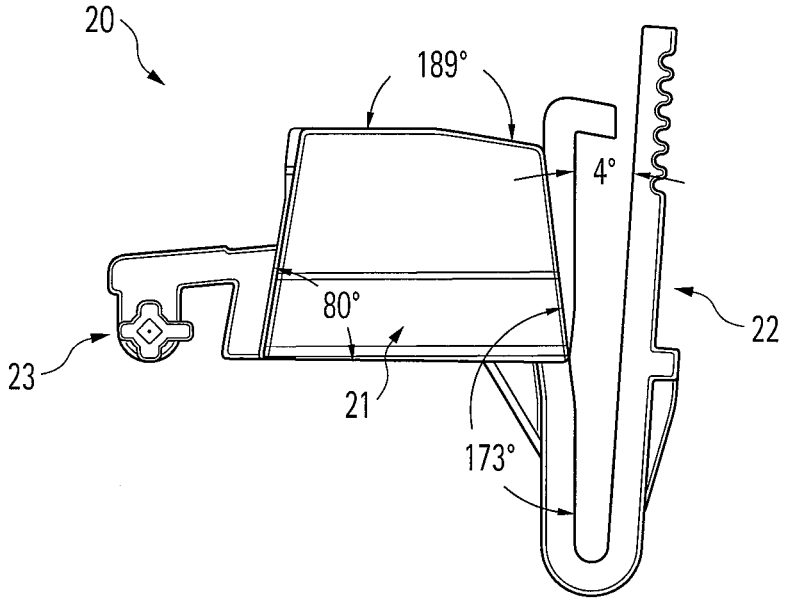
FIG. 2 *a-c*) an embodiment of a mounting member of the second type.
Figure 2B:
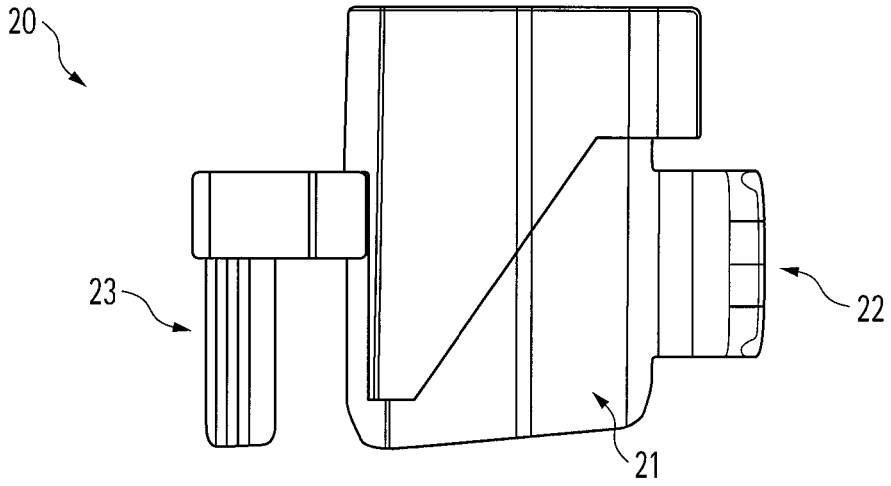
Figure 2C:
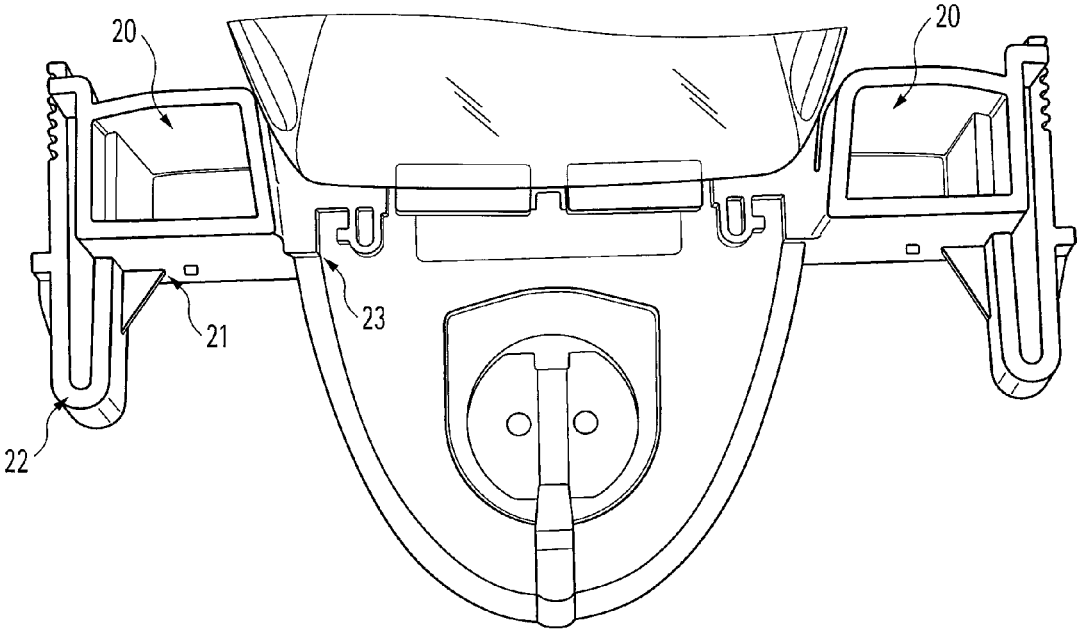

A preferred embodiment of the mounting member of the second type 20 is depicted in FIGS. 2*a* to 2*c*. The mounting member of the second type 20 deviates from the predescribed mounting member of the first type 10 in that the flat pivoting face 12 is replaced by snap-fitting means; a resilient snap-fitting clip 22 is arranged protruding from a polygonal central body 21 of the mounting member of the second type 20. The mounting member of the second type 20 comprises attachment means 23 similar in form and function to attachment means 13, comprised in the mounting member of the first type 10.

Providing headroom to actuate the resilient snap-fitting clip 22, the central polygonal and tapered body 21 is reduced in size with respect to the central body 11 of the mounting member of the first type 10, and exhibits with respect to the guiding faces 37 an identical functionality. Additionally to the resilient snap-fitting clip 22, a limiting face is arranged protruding into the actuation headroom of the snap-fitting clip. The snap-fitting clip 22 is provided with a gripping face and a sliding face, which exhibits a characteristic projection or nose, both supporting a rotational movement of the optical member 30 and yielding acoustical feedback once the optical member 30 is securely attached to the oblong luminaire, resulting in an unmistakable "click".

The second type of mounting member 20 comprises two mirror symmetrical makes; FIG. 2*c* explains in more detail a respective arrangement combined to the end cap of an oblong luminaire. Also the mounting member of the second type 20 projects beyond the housing 50 of the luminaire, in particular beyond the end cap; said favorably formed attachment means 23 foster a respective arrangement.

Once rotated into the proximity of the mounting member of the second type 20, the pivoting means 36, comprised in the optical member 30, respectively the end cap 35, cooperate slidingly with said siding face of the mounting member of the second type 20. In particular, the mentioned chevron like cutout provides a sliding face 37 arranged on the optical member 30, cooperating with the mounting member of the second type 20 slidingly.

Being further aligned with the luminaire, the optical member 30 actuates the snap-fitting means, respectively the snap fitting-clip 22, deflecting the clip 22 towards the limiting face. Once the optical member 30 favorably overlaps with the protrusion or nose, provided on the snap-fitting means, a rapid change in deflection is caused by the nose, resulting in a characteristic "click", thus signaling the user that the snap fitting means provide a save and latching combination of the luminaire and the optical member 30. Being in a mounted position the nose is snapped behind the top faces of the optical member 30, respectively snapped behind top faces of the pivoting means 26, comprised in the optical member 30.

Figure 6:
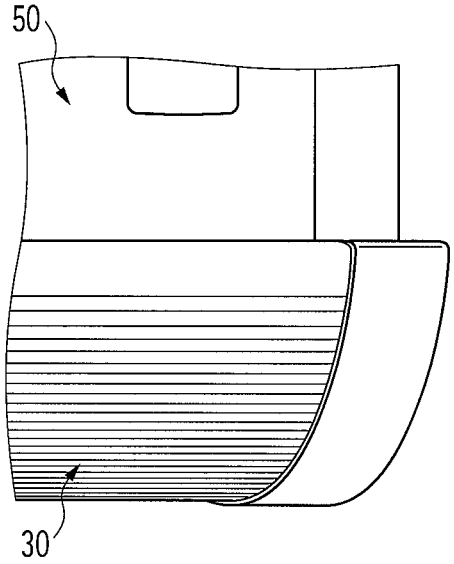
FIG. 6 a partial side view of an embodiment of oblong luminaire according to the invention.

As is also hinted by FIG. 6, the plurality of mounting members 10, 20 is provided to combine with the end caps at a surface forming an inner surface of the luminaire, in particular when being in a mounted position. Favorably the mounting members are arranged, not hampering the optical properties of the luminaire or the optical member 30.

Further fostering optical properties of the luminaire, the plurality of mounting members 10, 20 accommodate the optical member 30 at a surface forming an inner surface of the luminaire when being in a mounted position. In the depicted embodiment, the plurality of mounting members combine exclusively with end caps 35 comprised the optical member 30, which are preferably independent of any optical properties of the luminaire—as hinted in the embodiment, advantageously formed from an intransparent plastic material.

As can be further seen from FIG. 5*c*, the embodiment comprises mounting members of the second type 20, exhibiting actuation means accessible from the exterior of the luminaire. Said gripping faces arranged on the snap-fitting clip 22, protrude to the exterior of the luminaire, whereas the latching connection is provided at faces forming the interior of the luminaire.

Preferably the plurality of mounting members 10, 20 is formed from an intransparent plastic material as well, favorably allowing a molding process. More advantageously, the optical member 30 exclusively comprises a transparent material, defining preferably solely the optical properties of the luminaire.

Aided by the inventive mounting arrangement, possibilities are enhanced to optimize the mounting process and optical properties of an oblong luminaire, while significantly reducing respective efforts.

Furthermore is to be mentioned, that in the framework of the invention is conceivable combining all predescribed features or features disclosed in figures favorably with each other.

The invention claimed is:

1. Mounting arrangement for mounting an optical member to an oblong luminaire, said mounting arrangement comprising a plurality of mounting members arranged to be fixed to end caps of an oblong luminaire having two ends, the end caps being provided at narrow sides of the luminaire to accommodate an optical member, wherein the plurality of mounting members comprise:

two mirror symmetrical mounting members of a first type which are provided to be combined to one end cap of said luminaire and two mirror symmetrical mounting members of a second type which are provided to be combined to the other end cap of said luminaire, wherein the first type of mounting member is provided to pivotably accommodate the optical member and the second type of mounting member is arranged to snap-fittingly combine with the optical member.

2. Mounting arrangement according to claim 1, wherein the first type of mounting member is provided with a flat pivoting face projecting from a central body.

3. Mounting arrangement according to claim 1, wherein the second type of mounting member is provided with a snap-fitting clip projecting from a central body.

4. Mounting arrangement according to claim 1, wherein the mounting members and the optical member are provided to be combined and separated, obviating the usage of tools and/or the mounting members are provided to be combined to the luminaire and separated, obviating the usage of tools.

5. Mounting arrangement according to claim 1, wherein the plurality of mounting members are provided to combine with the end caps at a surface forming an inner surface of the luminaire when being in a mounted position.

6. Combination of a mounting arrangement according to claim 1 and an optical member, wherein the optical member is provided with pivoting means.

7. Combination of claim 6, wherein the plurality of mounting members accommodate the optical member at a surface forming an inner surface of a luminaire when being in a mounted position.

8. Combination according to claim 6, wherein the optical member is formed by a plurality of latchingly combined members.

9. Oblong luminaire comprising a combination according to claim 6, a housing provided with end caps at the narrow sides of the luminaire, and one or more lamps combined with the housing.

10. Luminaire according to claim 8, wherein the optical member when mounted to the luminaire exceeds a dimension of a narrow side of the luminaire housing.

11. Method for mounting an optical member to an oblong luminaire according to claim 9, comprising the steps A) combining the optical member with the first type of mounting member provided at a narrow end of the luminaire;

B) rotating the optical member around a pivoting axis perpendicular to a longitudinal direction of the luminaire; and, C) combining the optical member with the second type of mounting member provided at another narrow end of the luminaire.

12. Method according to claim 11, further comprising combining the first type of mounting member and the second type of mounting member to narrow end faces of the luminaire, obviating the usage of tools.

13. Method according to claim 11, further comprising first mounting the luminaire housing to a carrier and then mounting the optical member to the oblong luminaire.

14. Mounting arrangement according to claim 2, wherein the first type of mounting member is provided with a flat pivoting face projecting from a central polygonal body.

15. Mounting arrangement according to claim 1, wherein the second type of mounting member is arranged to combine snap-fittingly with the optical member with a "clicking" sound.

16. Mounting arrangement according to claim 3, wherein the second type of mounting member is provided with a snap-fitting clip projecting from a central polygonal body.

17. Combination according to claim 8, wherein the optical member is formed by a plurality of latchingly combined members, wherein a central member is formed by a trough like diffuser.

18. Combination according to claim 17, wherein the optical member is formed by a plurality of latchingly combined members, wherein a central member is formed by abutting end caps of the trough.

* * * * *